US005483698A

United States Patent [19]

Douglas, Jr.

[11] Patent Number: 5,483,698

[45] Date of Patent: Jan. 16, 1996

[54] HELMET SUPPORT AND MOVEMENT RESTRICTOR

[75] Inventor: Rogers W. Douglas, Jr., Houston, Tex.

[73] Assignee: Douglas Protective Equipment, Inc., Houston, Tex.

[21] Appl. No.: 312,872

[22] Filed: Sep. 27, 1994

[51] Int. Cl.[6] ..... A41D 13/00

[52] U.S. Cl. ..... 2/2

[58] Field of Search ..... 2/410, 415, 44, 2/45, 2, 909, 908; 602/17, 19, 18

[56] References Cited

U.S. PATENT DOCUMENTS

| | | | |
|---|---|---|---|
| 3,189,917 | 6/1965 | Sims | 2/2 |
| 3,497,872 | 3/1970 | Mitchell | 2/2 |
| 3,765,029 | 10/1973 | Germain | 2/2 |
| 3,900,896 | 8/1975 | Ackerman | 2/2 |
| 3,981,027 | 9/1976 | Anderson | 2/2 |
| 4,219,193 | 8/1980 | Newman | 272/94 |
| 4,338,685 | 7/1982 | LaPorta, Jr. | 2/2 |
| 4,501,023 | 2/1985 | Billberry | 2/908 |
| 4,590,622 | 5/1986 | Wolfe et al. | 2/2 |
| 4,821,339 | 4/1989 | Fair | 2/2 |
| 4,870,705 | 10/1989 | Higby et al. | 2/2 |
| 4,881,529 | 11/1989 | Santos | 2/2 |
| 4,996,720 | 3/1991 | Fair | 2/2 |
| 5,123,408 | 6/1992 | Gaines | 602/17 |
| 5,261,125 | 11/1993 | Cartwright | 2/421 |
| 5,404,590 | 4/1995 | Monica, Jr. | 2/2 |

*Primary Examiner*—C. D. Crowder
*Assistant Examiner*—Larry D. Worrell, Jr.
*Attorney, Agent, or Firm*—Akin, Gump, Strauss, Hauer & Feld

[57] ABSTRACT

A football shoulder pad assembly is provided with an improved helmet support and restrictor to minimize rearward hyperextension and whiplash-type head movement. The support and movement restrictor comprises a compression molded plastic support plate having opposed wing portions which are secured to the back plates of the shoulder pad assembly and an upward extending cantilever portion of the support plate having a side-to-side curvature to form a concave surface for engagement with the lower rear portion of the helmet. The cantilever portion is curved rearwardly away from the player's head and neck to minimize interference with normal movement of his head. The cantilever portion may flex during use to absorb impact-type hyperextension and whiplash forces. A removable cushion is secured to the cantilever portion of the support plate and includes a pad which may be adjustably fitted against the concave surface of the support plate by opposed flaps which include hook and loop fastener pieces secured thereto for attaching the cushion to the support plate. The restrictor may be retrofitted to existing shoulder pad assemblies.

14 Claims, 4 Drawing Sheets

HELMET SUPPORT AND MOVEMENT RESTRICTOR

FIELD OF THE INVENTION

The present invention relates to support equipment adapted for use by athletes, such as football players, in conjunction with athletic shoulder pads and helmets for opposing hyperextension and whiplash head movement.

1. Background of the Invention

Athletes participating in severe contact sports, such as American football, are subject to exposure to hyperextension and whiplash-type head movement. Players at positions such as interior lineman, for example, are subjected to physical contact on virtually every play which can force the player's head rapidly backward to create a whiplash effect which can result in serious and disabling injury. Moreover, persons involved in activities such as high speed vehicle test piloting and race car driving can also be exposed to hyperextension or whiplash-type injuries caused by high rates of acceleration and impact forces.

In all of the above-mentioned activities, it is desirable to minimize the chance of hyperextension or whiplash injury while also minimizing unwanted restriction to movement of the head. In other words, in the case of football athletes, protection against rearward hyperextension or whiplash-type injury is highly desired, but the player also does not want to have head movement restricted such as by attachment of any device to the helmet or to protective gear such as shoulder pads which will restrict turning of the head, side-to-side movement of the head, or even forward movement of the head when desired. At the same time, however, it is desirable to provide protective means which is capable of restricting rearward movement of the head and particularly rapid or whiplash-type movement. Moreover, the protective device should be able to distribute the forces between the protective device and the helmet and between the protective device and structure attached to the body to minimize discomfort or prevent injury to the wearer of the protective device at some other point.

Still further, the operating environment of protective devices, particularly for football players, is such that it is desirable to be able to replace at least a part of the protective device which comes in contact with the helmet after repeated exposure to perspiration, rain, snow and mud, for example. There is a continuing interest in providing improvements for use by persons requiring head protection, which will make the play of the game safer without unduly restricting normal head movement.

2. Description of the Prior Art

Several types of helmet restrictors have been developed for athletes participating in severe contact sports such as football wherein the player's helmet, for example, is interconnected with a set of shoulder pads, or other support structure worn on the shoulders, by a brace which restricts backward movement of the helmet. However, these devices also severely limit rotational or side-to-side movement of the head, which restriction is usually unwanted by the player and may interfere with play execution as a result of the limitations on head movement.

Yet another type of conventional protective device used by football athletes, in particular, comprises a cushion-like collar which is attached to the shoulder pads and substantially encircles the neck between the helmet and the pads. Again, that type of collar is uncomfortable and limits head movement in directions which the player may wish to make.

Such types of collars also tend to sometimes exert a choking effect on the wearer when severely deflected or purposely or inadvertently grabbed by another player during play action. Moreover, some conventional restraint devices have also been constructed in a manner which does not adequately take advantage of the load reacting and distributing capability of the largest structure worn by a football player, namely the shoulder pad assembly. The limitations of conventional devices noted herein, as well as others recognizable to those skilled in the art, have been substantially overcome by the protective helmet support and movement restrictor of the present invention.

SUMMARY OF THE INVENTION

The present invention provides a unique helmet support and movement restrictor particularly adapted to be used in conjunction with athletic shoulder pads for football players and the like.

In accordance with an important aspect of the present invention, a helmet support and movement restrictor is provided which limits movement of the helmet in a rearward whiplash direction without restricting desired side-to-side or turning movement of the helmet. The arrangement of the helmet support and movement restrictor is such as to avoid contact with the athlete's head and neck during normal activity while instead engaging the helmet and being capable of substantial cushioning action and rearward movement restriction in the event of backward hyperextension or whiplash-type movement of the helmet, particularly movement encountered during severe physical contact in sports such as American football.

In accordance with another important aspect of the present invention, a helmet support and movement restrictor is provided which is particularly adapted to be used in conjunction with a set of football shoulder pads wherein a cooperative force distributing and reacting effect between the shoulder pads, body arches or chest and back plates and the helmet movement restrictor is obtained.

In accordance with another important aspect of the present invention, a helmet support and movement restrictor for attachment to football shoulder pads is provided which may be easily retrofitted to existing shoulder pads or may be supplied with new shoulder pads when manufactured. The helmet support and movement restrictor advantageously utilizes a uniquely configured support plate having a cantilever support portion for supporting a removable cushion engageable with the player's helmet. The cushion may be retained on the support plate by releasable fastener means such as hook and loop-type fasteners for easy removal for cleaning and/or replacement.

The helmet support and movement restrictor of the present invention provides several advantages for use in conjunction with football shoulder pads. The configuration of the helmet support and movement restrictor avoids contact with the wearer during normal head movement, does not restrict turning or sideways head movement, does not attach to a helmet in such a way as to impose unwanted loads on other parts of the body when opposing hyperextension or whiplash movement, may be easily retrofitted to existing shoulder pad assemblies or easily attached to new shoulder pad assemblies during manufacture, and is itself relatively easy and economical to manufacture.

Those skilled in the art will further appreciate the above-mentioned features and advantages of the invention together with other superior aspects thereof upon reading the detailed description which follows in conjunction with the drawings.

DETAILED DESCRIPTION OF THE PREFERRED EMBODIMENT

Figure 1:
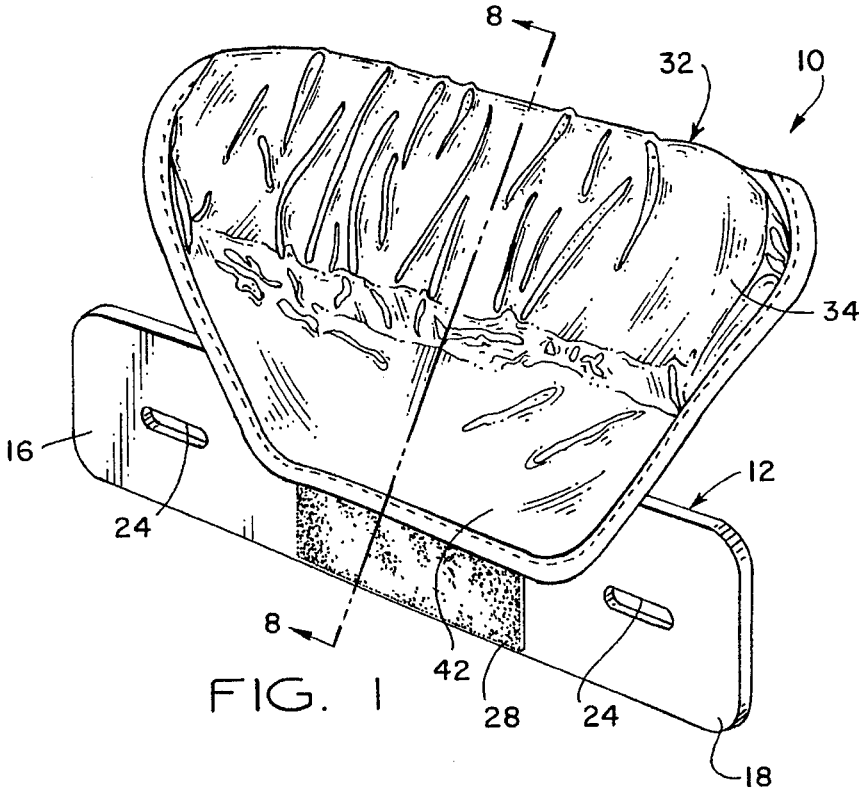
FIG. 1 is a front perspective view of the improved helmet support and movement restrictor of the present invention.

In the description which follows, like elements are marked throughout the specification and drawing with the same reference numerals, respectively. The drawing figures are not necessarily to scale in the interest of clarity and conciseness.

Figure 2:
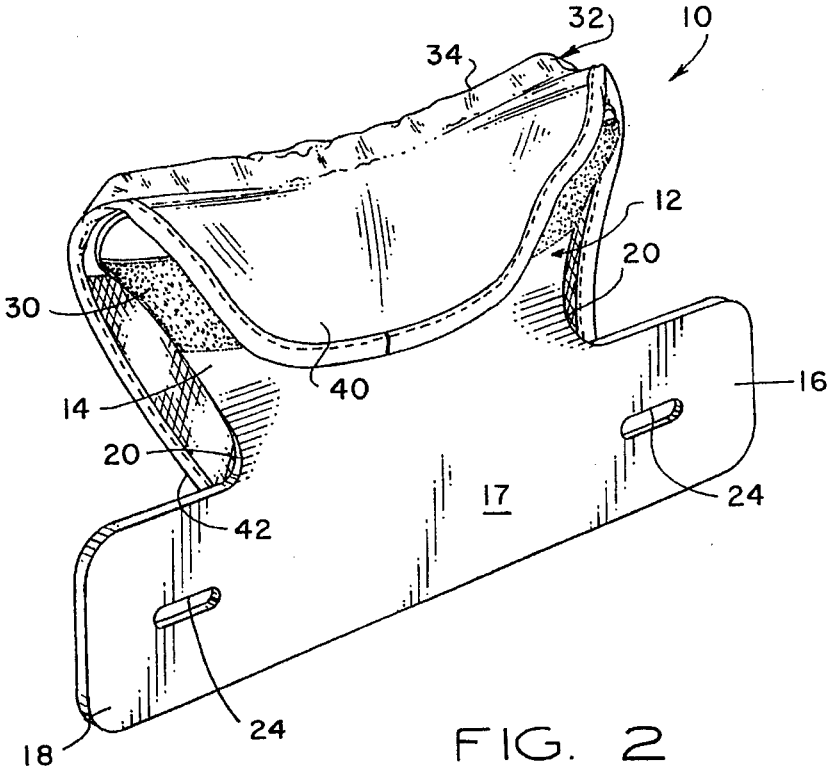
FIG. 2 is a rear perspective view of the helmet support and movement restrictor.

Referring to FIGS. 1 and 2, there is illustrated an improved helmet support and movement restrictor in accordance with the invention and generally designated by the numeral 10. The movement restrictor 10 is characterized by a unique support plate, generally designated by the numeral 12, which is also shown more clearly in FIGS. 5 and 6.

Figure 5:
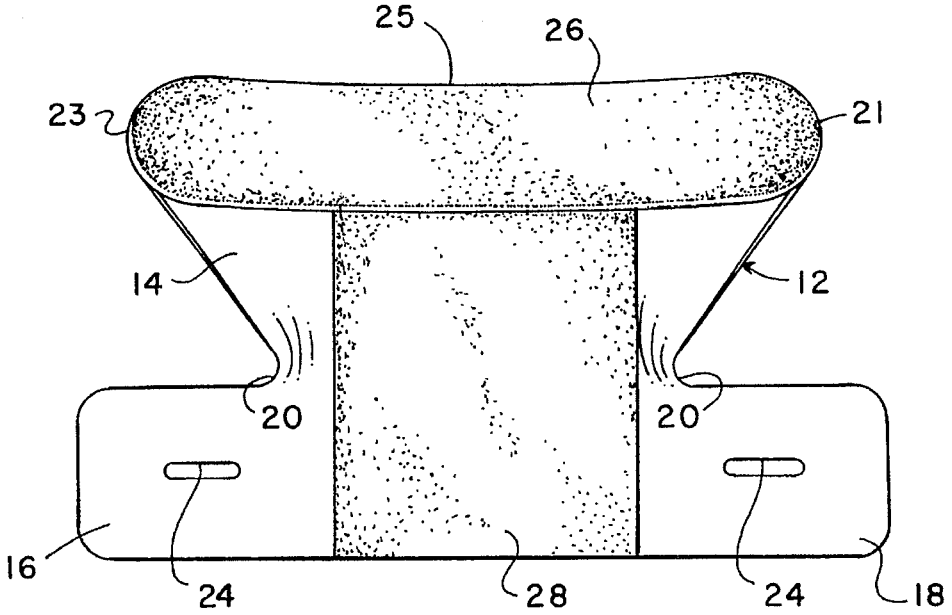
FIG. 5 is a front elevation of the helmet support and movement restrictor support plate.
Figure 6:
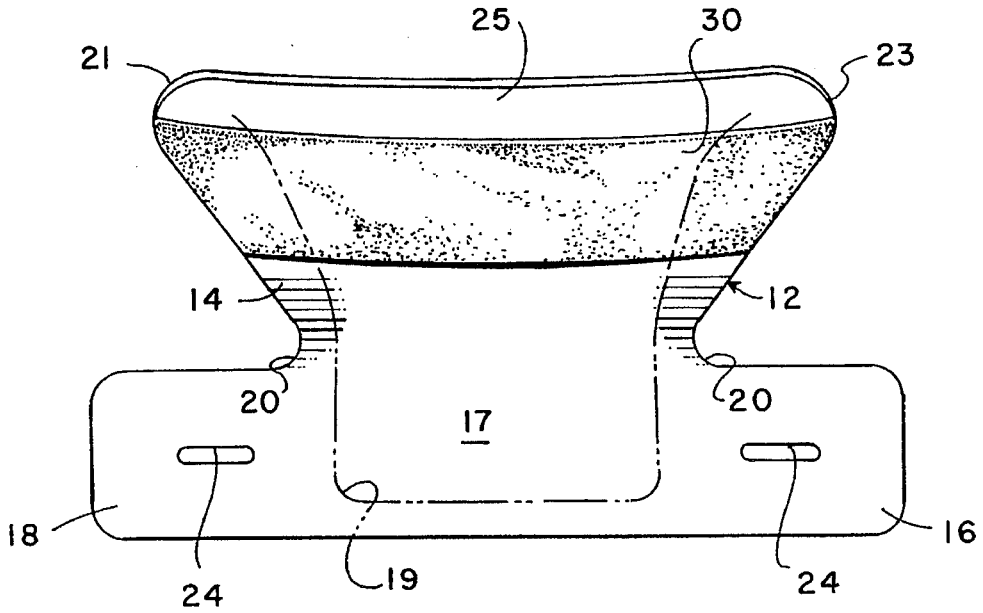
FIG. 6 is a rear elevation of the support plate.
Figure 7:
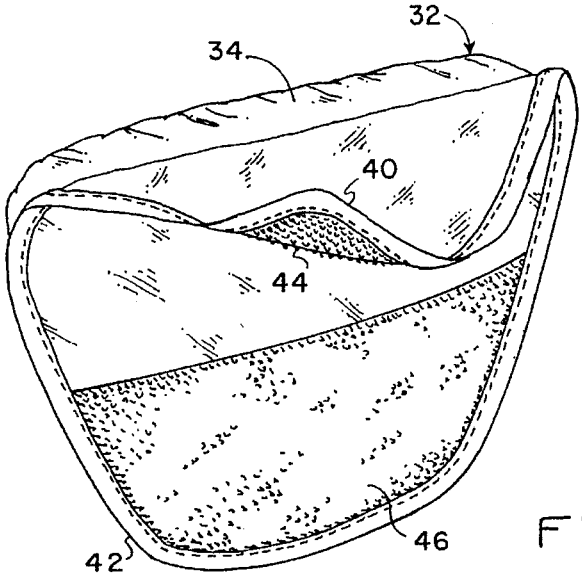
FIG. 7 is a rear perspective view of the removable cushion for the helmet support and movement restrictor.
Figure 8:
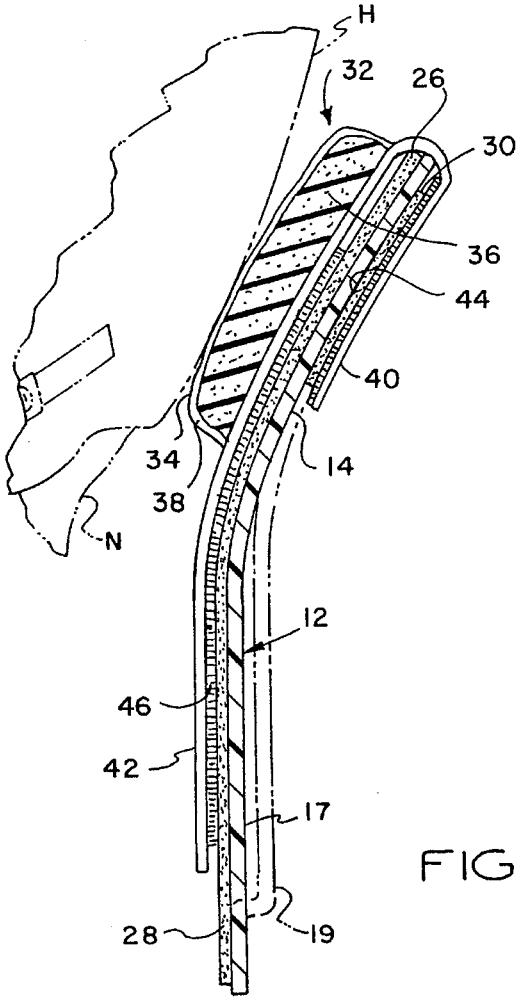
FIG. 8 is a section view taken generally along the line 8—8 of FIG. 1.

Referring to FIGS. 5 and 6, the support plate 12 includes a generally upwardly extending cantilever portion 14 which is integrally formed with opposed wing support portions 16, 18. The support plate 12 may be formed of a suitable plastic having a desirable modulus of elasticity and being capable of withstanding substantial impact and bending forces without plastic deformation or catastrophic failure. The plate 12 may be made of a material such molded nylon or ABS plastic having a thickness of about .140 inches. In particular, the upwardly extending cantilever portion 14 is bent or curved away from the wings 16, 18 and into the plane of the paper when viewing FIG. 5 and thus, it is bent outwardly out of the plane of the paper when viewing FIG. 6. FIG. 8 also illustrates the direction of bending of the cantilever portion 14 which provides for normal unrestricted head and neck movement. The wings 16, 18 and a connecting web portion 17, FIG. 6, are substantially coplanar.

Alternatively a generally rectangular, outwardly projecting recessed portion 19 may be formed, as defined within the outline shown in FIG. 6, to add stiffness to the plate 12. The recessed portion 19 flares into the backward curved cantilever portion 14, as shown in FIG. 8. The upstanding cantilever portion 14 is also integrally joined with the wings 16, 18 and the web portion 17 by generously curved radii 20 to minimize stress raisers at the juncture of the cantilever portion 14 with the support wings 16, 18. The cantilever portion 14 is also curved from side 21 to side 23 so that a concave arch 25 curves out of the plane of the paper in FIG. 6 and into the plane of the paper in FIG. 5. The arch 25, as will be appreciated from further description herein, thus aids in conforming the neck support and movement restrictor 10 to the shape of the lower back rim of the helmet.

Referring further to FIGS. 5 and 6, the opposed wing portions 16, 18 of the support plate include suitable fastener accommodating slots 24 for aid in securing the movement restrictor 10 to a set of football shoulder pads, for example. Still further, as shown in FIGS. 5 and 6, the plate 12 includes plural pads 26, 28 and 30 of one side of a hook and loop fastener system. The pad 26 extends across the cantilever portion 14 on the front or concave side thereof, and the pad 30 also extends substantially across the breadth of the cantilever portion 14 across the back or convex side thereof. The pads 26, 28 and 30, which may vary in size from those shown, may be suitably secured to the plate 12 by an adhesive backing on respective ones of the pads.

Referring now to FIGS. 1, 2, 7 and 8, in particular, the movement restrictor 10 further includes a unique removable cushion, generally designated by the numeral 32. The cushion 32 includes a cushion pad 34 which is characterized by a compressible plastic foam core or filler 36, FIG. 8, suitably encapsulated by an abrasion-resistant fabric cover 38 which is further characterized by opposed top and bottom flaps 40, 42. The flaps 40, 42 have secured thereto, respectively, opposites sides of hook and loop fastener strips 44, 46, respectively, for securing the cushion 32 to the support plate 12 as shown in FIGS. 1, 2 and 8.

Accordingly, the flap 40 is secured along its strip 44 to the hook and loop fastener strip 30 and is thus folded over the top edge of the plate portion 14. The flap 42 extends down along the hook and loop fastener strips or pads 26, 28 and has its fastener strip 46 secured thereto over a generous area to substantially prevent unwanted movement or removal of the pad 32 from the support plate 12. The fabric cover 38 for the cushion 34 and the flaps 40, 42 may be formed of suitably sewn together bordered panels of an abrasion and moisture-resistant fabric such as 200 denier urethane coated moisture-resistant nylon, for example.

The removable pad 32 offers several advantages with respect to the improved helmet support and movement restrictor 10. The size and thickness of the cushion pad 34 may be modified so that the cushion 32 is available in different sizes and shapes to accommodate the helmet size of the user. The cushion 32 may be easily removed and replaced with a similar cushion having a slight or substantially different size and shape of the cushion pad 34. Moreover, if the cushion 32 is damaged or becomes extremely wet and dirty in use, it may be easily replaced at will. Still further, the relatively broad expanse of the hook and loop fastener parts 26, 28, 30, 44 and 46 provide for substantial adjustment of the position of the cushion pad 34 on the support plate 12 to satisfy the player's helmet size requirements and comfort.

Figure 3:
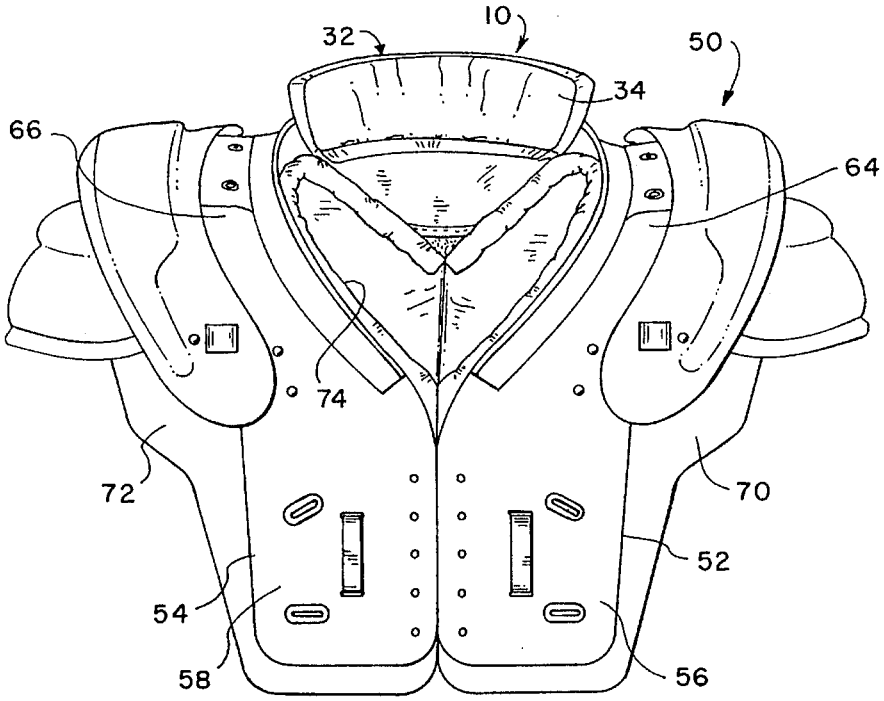
FIG. 3 is a front elevation of a set of American football shoulder pads including the helmet support and movement restrictor in assembly therewith.
Figure 4:
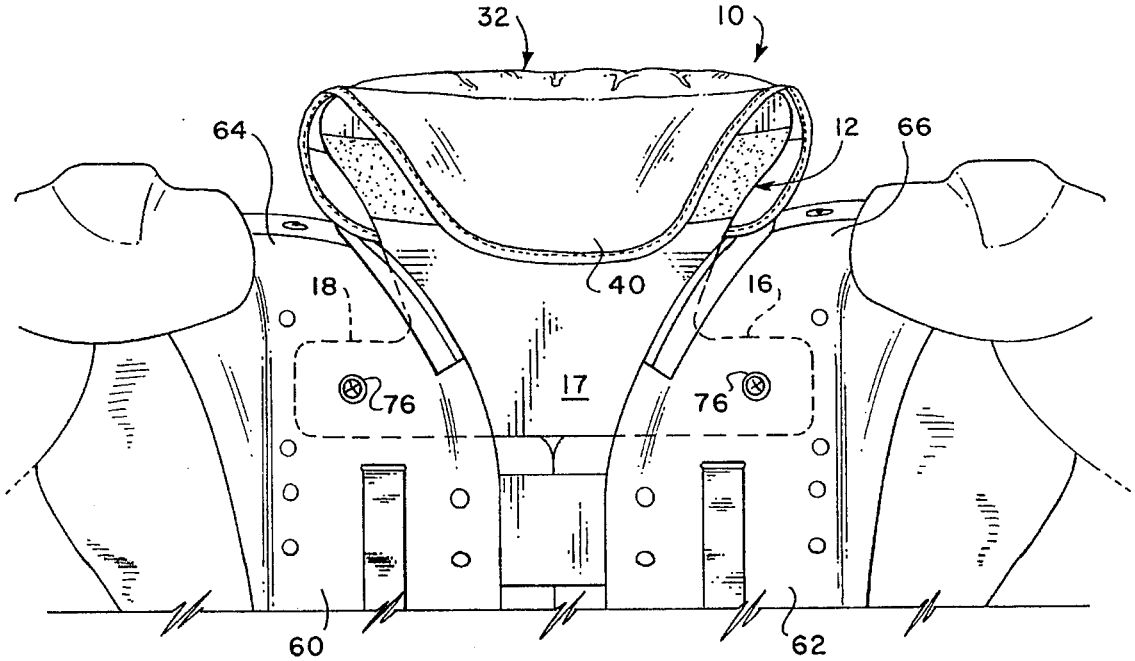
FIG. 4 is a back elevation detail of the shoulder pads shown in FIG. 3.

Referring now to FIGS. 3 and 4, the unique helmet support and movement restrictor 10 is shown disposed in its working position in conjunction with a football shoulder pad assembly 50. The shoulder pad assembly 50 is characterized by a pair of opposed body arches 52, 54 which include front or breast plate parts 56, 58 which are integrally joined with back plate parts 60, 62 by arch portions 64, 66, respectively. The shoulder pad assembly 50 may be of generally conventional construction, with the exception of the addition of the unique helmet support and movement restrictor 10, and includes conventional opposed shoulder caps and epaulets which form no part of the present invention and will not be described in detail herein. The body arches 52, 54 are suitably secured to arched pad parts 70, 72 which are configured to define a suitable head and neck opening 74. The body arches 52, 54 are also configured to provide unrestricted access to the neck opening 74.

As shown in FIG. 4, the helmet support and movement restrictor 10 is secured to the back plates 60, 62 by respective fasteners 76 which may extend through pre-drilled holes in the back plates, through the cooperating fastener slots 24 and are threadedly engaged with suitable fastener elements such as flat nuts or the like (not shown). Alternatively, the screws 76 may be self-tapping and of a type which could be forcibly engaged with the wing portions 16, 18 of the support plate 12. As a result of the configuration of the support plate 12, having the opposed generally planar wing portions 16, 18 which are integrally formed with the web 17 and the cantilever plate portion 14, forces exerted on the cantilever plate portion 14 are transmitted to the back plates 60, 62 of the shoulder pad assembly 50 and distributed widely thereover to minimize concentration of forces on the shoulder pad assembly. Moreover, by permitting the cantilever portion 14 of the support plate 12 to be unencumbered by the body arches 50, 52, the plate may flex substantially to absorb impact loads such as might be caused by hyperextension or whiplash movement of the player's helmet.

Referring to FIG. 8, a rearward hyperextension or a whiplash-type movement of the helmet is opposed strongly by the support and movement restrictor 10 thanks to the configuration of the support plate 12 and its support by the back plates 60, 62 of the shoulder pad assembly 50. Note that only the helmet H engages the restrictor 10 and that the player's neck N does not touch the restrictor. The helmet H is free to roll from side-to-side on the concave arched portion 14. The forces exerted on the support and movement restrictor 10 are immediately reacted through the back plates 60, 62 tending to flex these plates outwardly away from the wearer's body. The elastic deflection of the arches 64, 66 aids in absorbing the loading on the body arch parts 52, 54. Moreover, the chest plates 56, 58 then react the forces broadly across the chest of the wearer with no discomfort resulting from the forces exerted on the movement restrictor 10.

The construction and use of the helmet support and movement restrictor 10, in conjunction with the shoulder pad assembly 50, is believed to be readily understandable to those of ordinary skill in the art from the foregoing description. The restrictor 10 can be easily included in the shoulder pad assembly 50 at the time of manufacture or can be retrofitted to existing shoulder pad assemblies, if desired. The materials used in fabricating the support and movement restrictor 10 have been described in some detail, and the fabrication of the component parts of the restrictor are believed to be within the capability of those skilled in the art.

Although a preferred embodiment of the invention has been described in detail herein, those skilled in the art will further appreciate that various substitutions and modifications may be made to the embodiment described without departing from the scope and spirit of the invention as set forth in the appended claims.

What is claimed is:

1. A helmet support and movement restrictor for use in conjunction with a shoulder pad assembly for restricting rearward movement of a helmet while permitting side-to-side movement of said helmet, said shoulder pad assembly having means forming opposed body arches with opposed back plate portions, said movement restrictor comprising:

a support plate including opposed wing portions joined by a connecting web disposed between said wing portions, said wing portions including means for connecting said wing portions to respective ones of said back plate portions of said shoulder pad assembly; and, an upwardly projecting cantilever portion of said support plate joined to said web and being operable in response to forces imposed thereon by a helmet engaging said cantilever portion to deflect above said web and to transfer forces through said web and said wing portions to said opposed back plate portions.

2. A helmet support and movement restrictor as set forth in claim 1, including:

cushion means disposed on said cantilever portion for engagement with said helmet being worn by the wearer of said movement restrictor.

3. A helmet support and movement restrictor set forth in claim 2, wherein:

said cushion means comprises a cushion pad of resilient material and opposed flap parts connected to said pad; and said cushion means and said support plate include cooperative fastener means for removably securing said cushion means to said support plate at will.

4. A helmet support and movement restrictor set forth in claim 3, wherein:

said fastener portions comprise opposed hook and loop fastener parts on said flaps and said support plate, respectively.

5. A helmet support and movement restrictor set forth in claim 1, wherein:

said support plate is curved from side-to-side to form a concave recess for providing a contour to fit the wearer's helmet to distribute forces exerted between said helmet and the movement restrictor substantially uniformly thereover.

6. A helmet support and movement restrictor set forth in claim 3, wherein:

said fastener means on said support plate and on said cushion means are of sufficient length and breadth to permit adjustment of the position of said pad with respect to said support plate.

7. A helmet support and movement restrictor set forth in claim 1, wherein:

said wing portions of said support plate extend laterally beyond a juncture of said cantilever portion with said web and are substantially coplanar with each other and with said web for reacting forces exerted on said cantilever portion to said back pate portions of said shoulder pad assembly and for permitting flexure of said cantilever portion of said support plate with respect to said wing portions and said web.

8. A helmet support and movement restrictor set forth in claim 1, wherein:

said cantilever portion of said support plate extends laterally outwardly at a distal end of said cantilever portion with respect to a juncture of said cantilever portion of said support plate with said wing portions and said web for engagement with the helmet of said wearer.

9. A helmet support and movement restrictor set forth in claim 1 wherein:

at least part of said cantilever portion is formed to have a recessed portion to increase the stiffness thereof.

10. A helmet support and movement restrictor for use with a football shoulder pad assembly to restrict rearward hypertension and whiplash movement of a helmet being worn by a football player while permitting side-to-side movement of said helmet, wherein the shoulder pad assembly includes means forming opposed back plate portions of said shoulder pad assembly, said restrictor comprising:

a support plate comprising opposed wing portions joined by a web disposed between said wing portions, said wing portions being adapted to be secured to said back plate portions of said shoulder pad assembly below the neck of the wearer of said shoulder pad assembly, and an upwardly projecting cantilever portion of said support plate integrally joined to said web, said cantilever portion projecting laterally beyond a juncture of said web with said cantilever portion, and said cantilever portion being curved in a direction to form a concave surface for engagement with said helmet, and said support plate being further configured to have said cantilever portion curved backwardly away from the neck of said wearer when said shoulder pad assembly is positioned in a normal working position on said wearer to minimize interference of said restrictor with normal movement of said helmet; and cushion means disposed on said cantilever portion of said support plate and engageable with said helmet to cushion any forces exerted between said support plate and said helmet and to distribute reacting forces of said support plate over substantially the breadth thereof whereby substantial restriction to hyperextension and whiplash movement of said helmet is provided while minimizing restriction to side-to-side movement of said helmet.

11. A helmet support and movement restrictor set forth in claim 10, wherein:

said cushion means comprises a cushion pad and opposed flaps formed of flexible fabric secured to said cushion pad and cooperating fastener means on said support plate and said cushion means for removably securing said cushion means to said cantilever portion of said support plate.

12. In a football shoulder pad assembly having means forming body arches and opposed back plates of said body arches, the improvement comprising a protective support and movement restrictor apparatus for restricting rearward movement of a helmet being worn by a football player characterized by a support plate having opposed wing portions including means for securing said wing portions to respective portions of said back plates of said body arches and an upwardly projecting cantilever portion of said support plate secured to said wing portions by a web extending between said wing portions, said cantilever portion being curved from side-to-side to form a concave surface for engagement with the helmet and said cantilever portion being curved rearwardly at its upper distal end away from the lower head and neck of the football player to minimize interference with normal forward and side head movement of the football player while providing substantial restriction to rearward movement of the helmet during imposition of one of hyperextension and whiplash forces.

13. The invention as set forth in claim 12 including:

cushion means disposed on said cantilever portion comprising a cushion pad of resilient material and opposed flap parts connected to said pad, said cushion means and said support plate include cooperative fastener means for removably securing said cushion means to said support plate at will.

14. The invention as set forth in claim 12, wherein:

said cantilever portion of said support plate extends laterally outwardly at a distal end of said cantilever portion with respect to a juncture of said cantilever portion of said support plate with said web.

* * * * *